US009408484B2

(12) United States Patent
Schofield et al.

(10) Patent No.: US 9,408,484 B2
(45) Date of Patent: Aug. 9, 2016

(54) SLEEPING BAG WITH SELF-SEALING, VENTED FOOTBOX

(71) Applicant: American Recreation Products, LLC., Boulder, CO (US)

(72) Inventors: Chase Schofield, Boulder, CO (US); Casey Sumnicht, Longmont, CO (US)

(73) Assignee: Exxel Outdoors, LLC, Boulder, CO (US)

( * ) Notice: Subject to any disclaimer, the term of this patent is extended or adjusted under 35 U.S.C. 154(b) by 17 days.

(21) Appl. No.: 14/244,069

(22) Filed: Apr. 3, 2014

(65) Prior Publication Data

US 2015/0128345 A1 May 14, 2015

Related U.S. Application Data

(60) Provisional application No. 61/902,628, filed on Nov. 11, 2013.

(51) Int. Cl.
*A47G 9/08* (2006.01)

(52) U.S. Cl.
CPC ..... *A47G 9/086* (2013.01)

(58) Field of Classification Search
CPC ..... A47G 9/00; A47G 9/08; A47G 9/083; A47G 9/086
See application file for complete search history.

(56) References Cited

U.S. PATENT DOCUMENTS 4,217,662 A * 8/1980 Buchman ..... 2/69.5
5,152,017 A 10/1992 Jaeger
5,881,405 A * 3/1999 Garrigues ..... 5/413 R
D569,159 S * 5/2008 Walker ..... D6/595
D586,537 S * 2/2009 Walker ..... D2/719
7,752,690 B1 7/2010 Seth (Continued)

FOREIGN PATENT DOCUMENTS

CN 203633890 U 6/2014
JP 10108774 A 4/1988

(Continued)

OTHER PUBLICATIONS

Backcountry Bed-A zipper-less sleeping bag for improved comfort. Sep. 2, 2013, http://www.homeharmonizing.com/2013/09/02/backcountry-bed-a-zipper-less-sleeping-bag-for-improved-comfort/.

(Continued)

*Primary Examiner* — Robert G Santos
*Assistant Examiner* — Myles Throop
(74) *Attorney, Agent, or Firm* — Stinson Leonard Street LLP

(57) ABSTRACT

A sleeping bag has an elongate shell defining an inner volume sized and shaped to receive a user therein. The shell has a head portion, a foot portion, a middle portion extending longitudinally between the head and foot portions, an overlying portion adapted to overlie the user during use, an underlying portion adapted to underlie the user during use, and a vent. The vent is selectively moveable between a closed configuration and an opened configuration to enable the user to access the exterior of the sleeping bag from within the sleeping bag. The vent comprises an inner panel and an outer panel. The inner panel is positioned in overlapping face-to-face engagement with the outer panel in the closed configuration. The outer panel is spaced from the inner panel in the opened configuration to define a passage to enable the user to extend his or her feet through the vent.

21 Claims, 15 Drawing Sheets

(56) References Cited

U.S. PATENT DOCUMENTS

| | | | | |
|---|---|---|---|---|
| 2005/0028277 | A1* | 2/2005 | Gordon et al. | 5/420 |
| 2005/0034234 | A1* | 2/2005 | Bellick et al. | 5/413 R |
| 2005/0034235 | A1 | 2/2005 | Bellick et al. | |
| 2006/0212989 | A1* | 9/2006 | White | 2/159 |
| 2007/0061966 | A1* | 3/2007 | Seth | 5/413 R |
| 2009/0113628 | A1* | 5/2009 | Hui | 5/413 R |
| 2009/0271909 | A1* | 11/2009 | Hegland | 2/69.5 |
| 2010/0256716 | A1* | 10/2010 | Haislip | 607/108 |
| 2013/0117933 | A1* | 5/2013 | Mickle et al. | 5/413 R |
| 2014/0352061 | A1* | 12/2014 | Flora et al. | 5/413 R |
| 2014/0352063 | A1* | 12/2014 | Mitchell et al. | 5/494 |
| 2014/0366269 | A1* | 12/2014 | Brensinger et al. | 5/413 R |
| 2015/0230526 | A1* | 8/2015 | Flora | A47G 9/08 5/413 R |

FOREIGN PATENT DOCUMENTS

| | | | |
|---|---|---|---|
| JP | 10108774 | A * | 4/1998 |
| WO | 2011019826 | A2 | 2/2011 |

OTHER PUBLICATIONS

International Search Report and Written Opinion for PCT/US2014/032756 mailed Sep. 4, 2014.

* cited by examiner

SLEEPING BAG WITH SELF-SEALING, VENTED FOOTBOX

CROSS-REFERENCE TO RELATED APPLICATION

This nonprovisional application claims priority to U.S. Provisional Patent Application Ser. No. 61/902,628, filed on Nov. 11, 2013, which is incorporated in its entirety by reference.

FIELD

The field of this disclosure relates generally to sleeping bags, and more particularly to sleeping bags having a self-sealing vent opening selectively moveable from a closed configuration to an opened configuration for venting an inner volume of the sleeping bags.

BACKGROUND

Typically, sleeping bags are used when conventional bed and bedding are unavailable. For example, sleeping bags are used by backpackers, hikers, campers, mountaineers, and other users as portable beds or coverings. Sleeping bags are often durable sleeping coverings that provide a soft surface, insulation, and weather resistance.

Consumers face a difficult task in finding a sleeping bag that is thermally efficient, comfortable, and lightweight. One type of sleeping bag is referred to as a "mummy bag", which tends to be shaped with a lateral taper to approximate the contour of the body of a user and thereby minimize the internal volume of the bag. Mummy bags attempt to conserve heat by minimizing air movement within and from the bag. As a result, mummy bags are often suited for use in outdoor, colder ambient temperatures. One drawback to the mummy bag is that some users may feel discomfort due to the tight fit of the bag. Some users may become too warm or the air within the bag may become stagnant. Such feeling of discomfort may be increased in the foot portion of the bag due to its distance from the opening of the bag. Thus, some users are unable to sleep comfortably in mummy bags.

Other sleeping bags, such as rectangular-type sleeping bags, are shaped with a generally constant lateral dimension and provide a greater range of motion for the user. Such bags also typically have a zippered portion to allow the user to more easily enter the bag. However, although rectangular bags are often more spacious than mummy bags, one drawback is that the larger internal volume reduces the thermal efficiency of the bag. Moreover, rectangular bags often do no insulate the head, and are typically too large to be thermally efficient. As a result, rectangular bags tend to be better suited for use indoors or in milder outdoor temperatures. When used in outdoor, colder ambient temperatures, air within the bag can more easily become chilled, especially in the foot portion of the bag.

Accordingly, a need exists for a sleeping bag that is both comfortable, thermally efficient, and allows the warm, stagnant air within the bag to escape and be replaced with fresh, ambient air.

BRIEF DESCRIPTION

In one aspect, a sleeping bag generally comprises an elongate shell defining an inner volume sized and shaped to receive a user therein. The shell has a head portion, a foot portion, a middle portion extending longitudinally between the head and foot portions, an overlying portion adapted to overlie the user during use, an underlying portion adapted to underlie the user during use, and a vent. The vent is selectively moveable between a closed configuration and an opened configuration to enable the user to access the exterior of the sleeping bag from within the bag. The vent comprises an inner panel and an outer panel. The inner panel is positioned in overlapping face-to-face engagement with the outer panel in the closed configuration. The outer panel is spaced from the inner panel in the opened configuration to define a passage to enable the user to extend his or her feet through the vent.

In another aspect, a sleeping bag generally comprises an elongate shell defining a longitudinal centerline and an inner volume sized and shaped to receive a user therein. The shell has an overlying portion adapted to overlie the user during use, an underlying portion adapted to underlie the user during use, and a vent. The vent has an opening selectively moveable between a closed configuration and an opened configuration to enable the user to access the exterior of the sleeping bag from within the sleeping bag. The opening extends substantially perpendicular to the longitudinal centerline. The vent is fastener free.

In yet another aspect, a sleeping bag generally comprises an elongate shell defining a longitudinal centerline and an inner volume sized and shaped to receive a user therein. The shell has a head end panel, a foot end panel, and a pair of spaced side panels extending longitudinally between the head end panel and the foot end panel, an overlying portion adapted to overlie the user during use, an underlying portion adapted to underlie the user during use, and a pair of vents. Each of the vents is selectively moveable between a closed configuration and an opened configuration to enable the user to access the exterior of the sleeping bag from within the sleeping bag. Each of the vents comprises an inner panel and an outer panel. The inner panel is positioned in overlapping face-to-face engagement with the outer panel in the closed configuration. The inner panel and the outer panel are generally perpendicular to the underlying portion in the closed configuration.

BRIEF DESCRIPTION OF THE DRAWINGS

Corresponding reference characters indicate corresponding parts throughout the several views of the drawings.

DETAILED DESCRIPTION OF THE DRAWINGS

Figure 1:
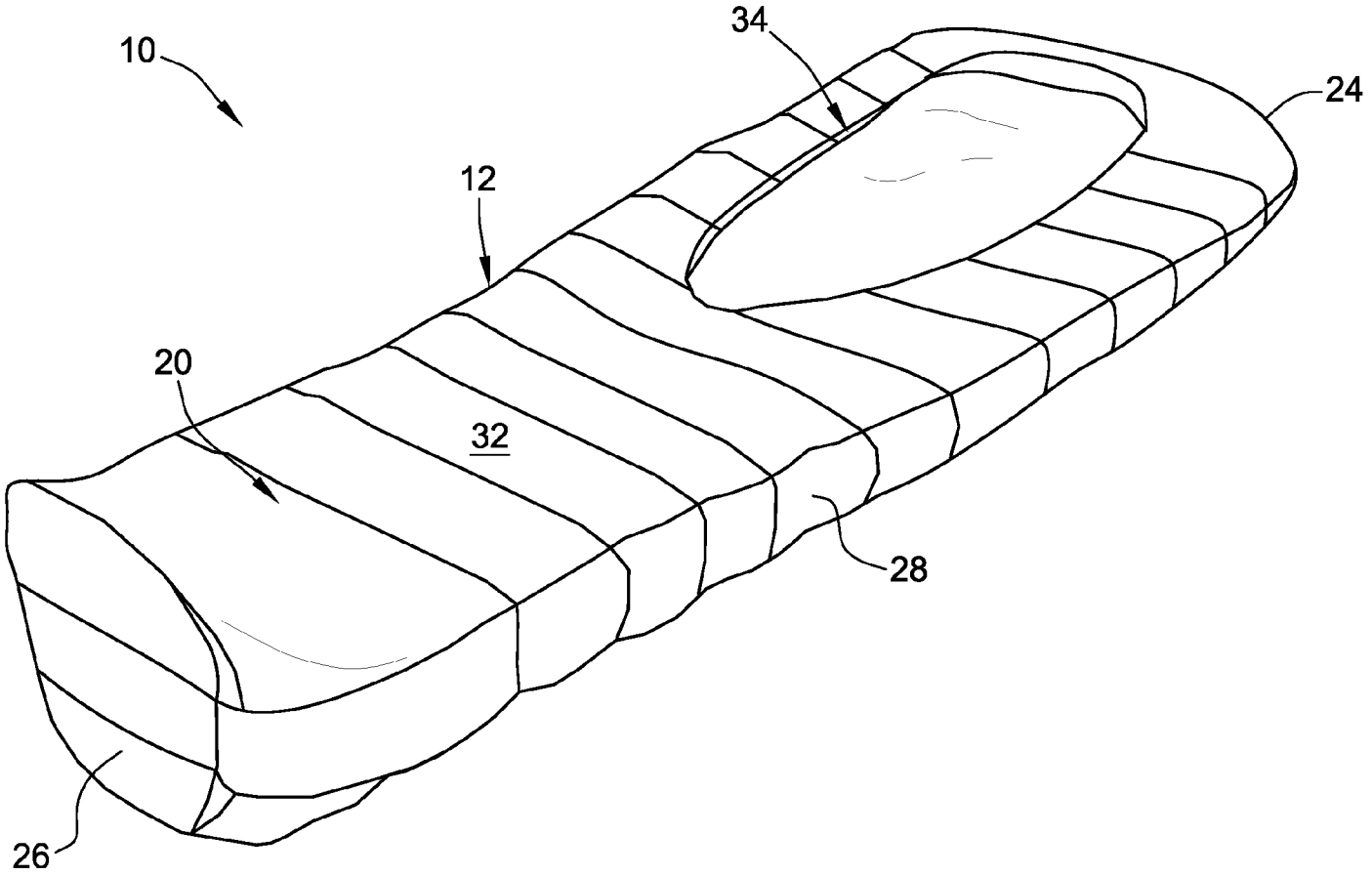
FIG. 1 is a perspective view of one embodiment of a sleeping bag having a vent.
Figure 2:
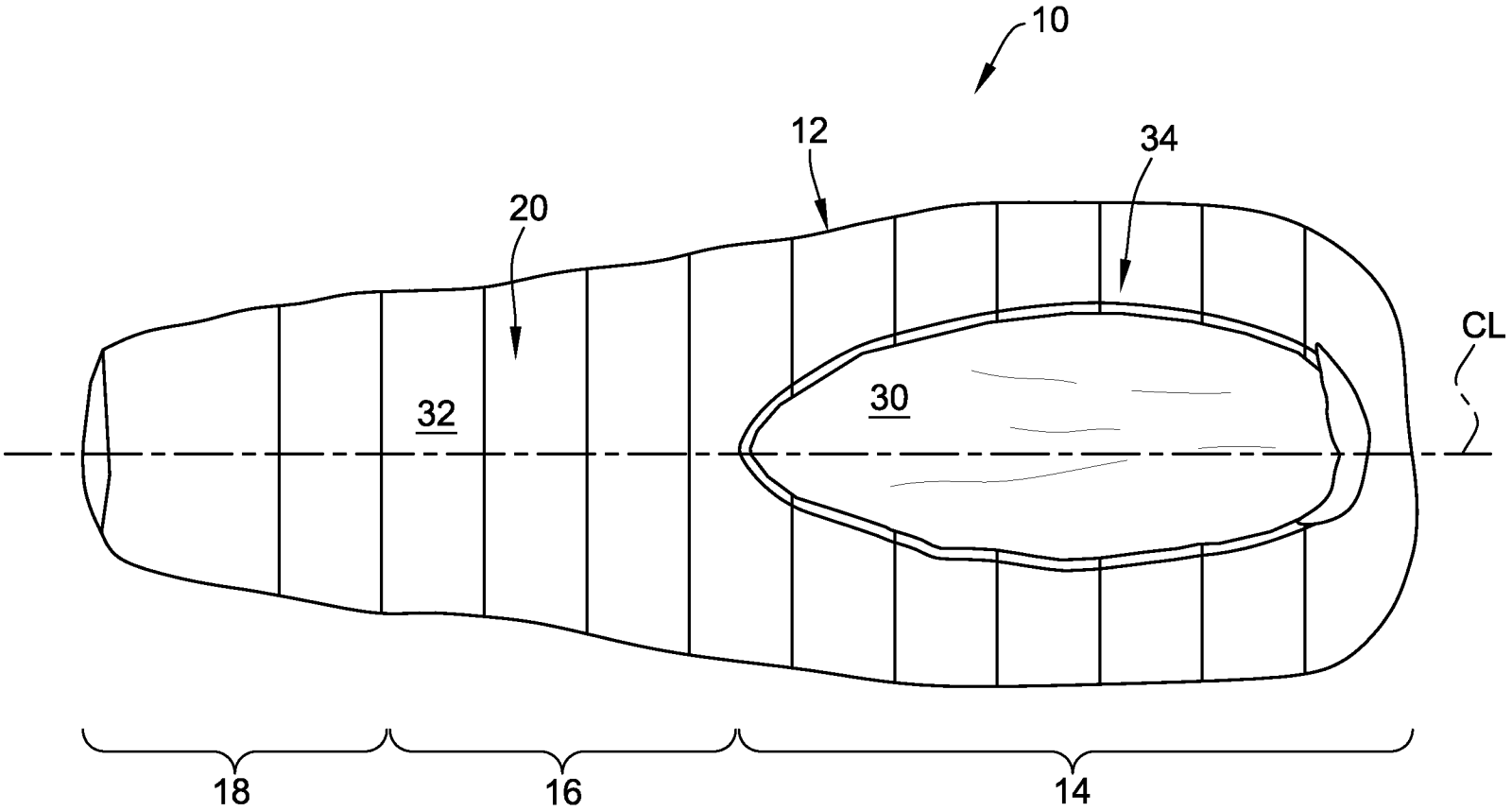
FIG. 2 is a top plan view of the sleeping bag of FIG. 1.
Figure 3:
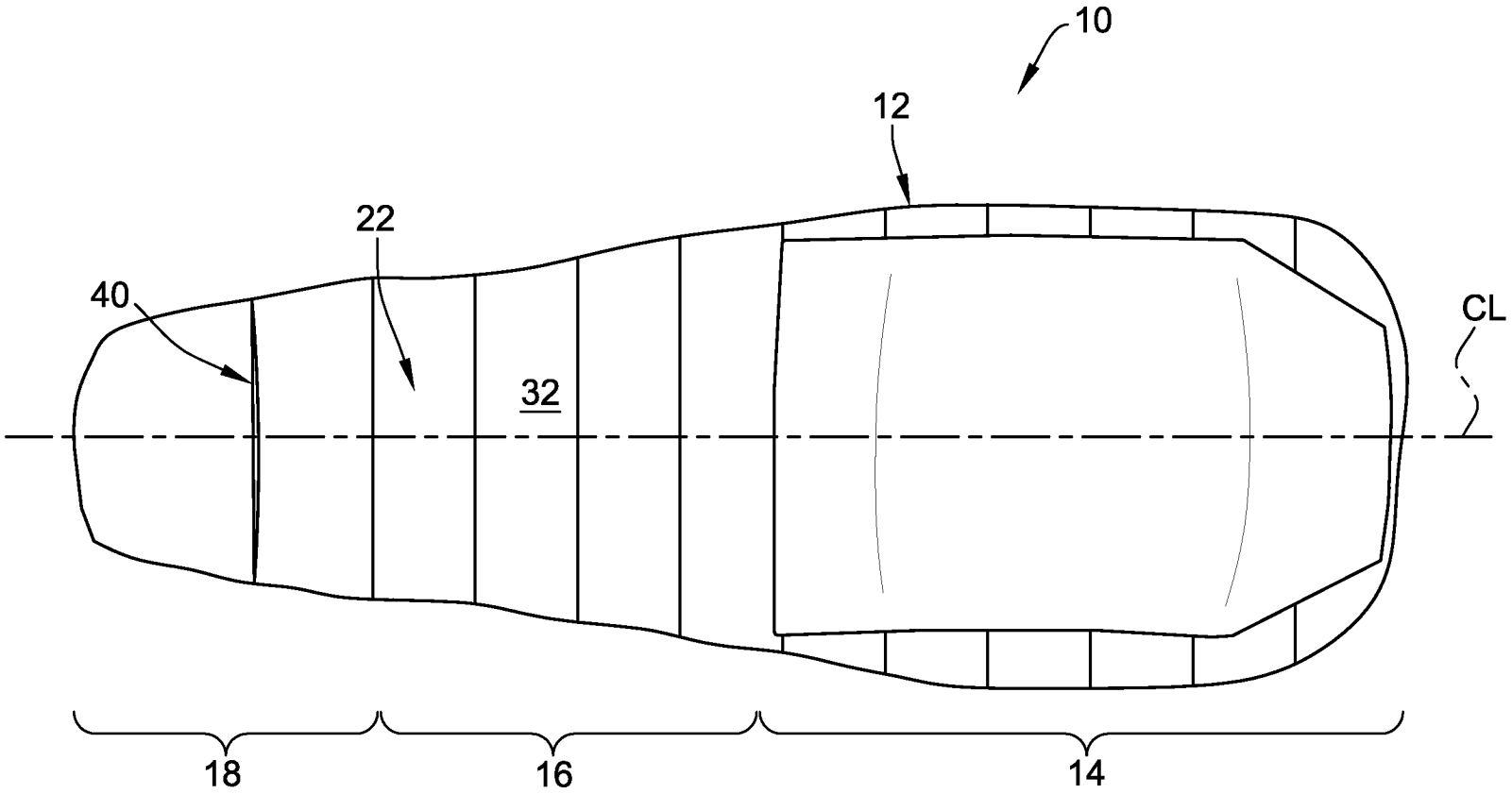
FIG. 3 is a bottom plan view of the sleeping bag of FIG. 1.
Figure 4:
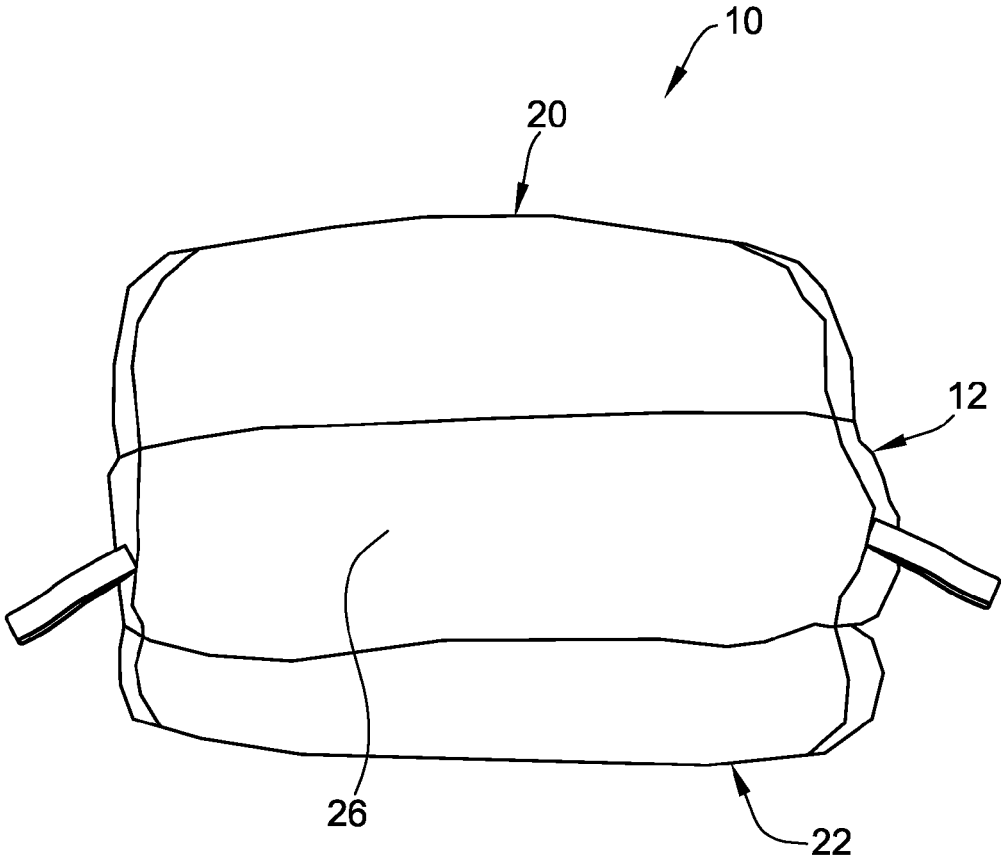
FIG. 4 is an end view showing a foot end panel of the sleeping bag of FIG. 1.
Figure 5:
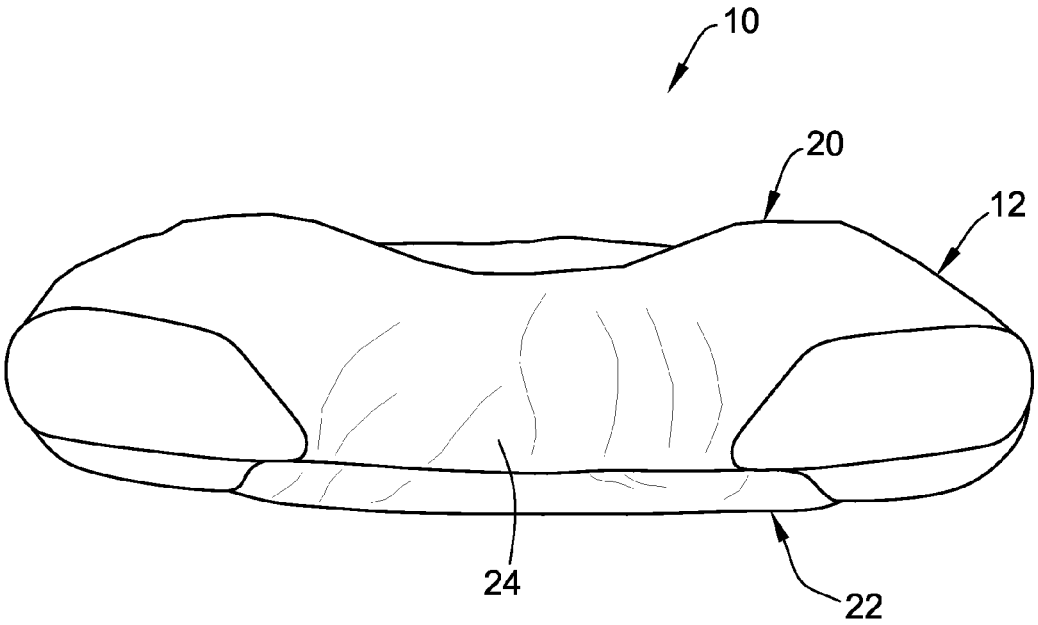
FIG. 5 is an end view showing a head end panel of the sleeping bag of FIG. 1.
Figure 6:
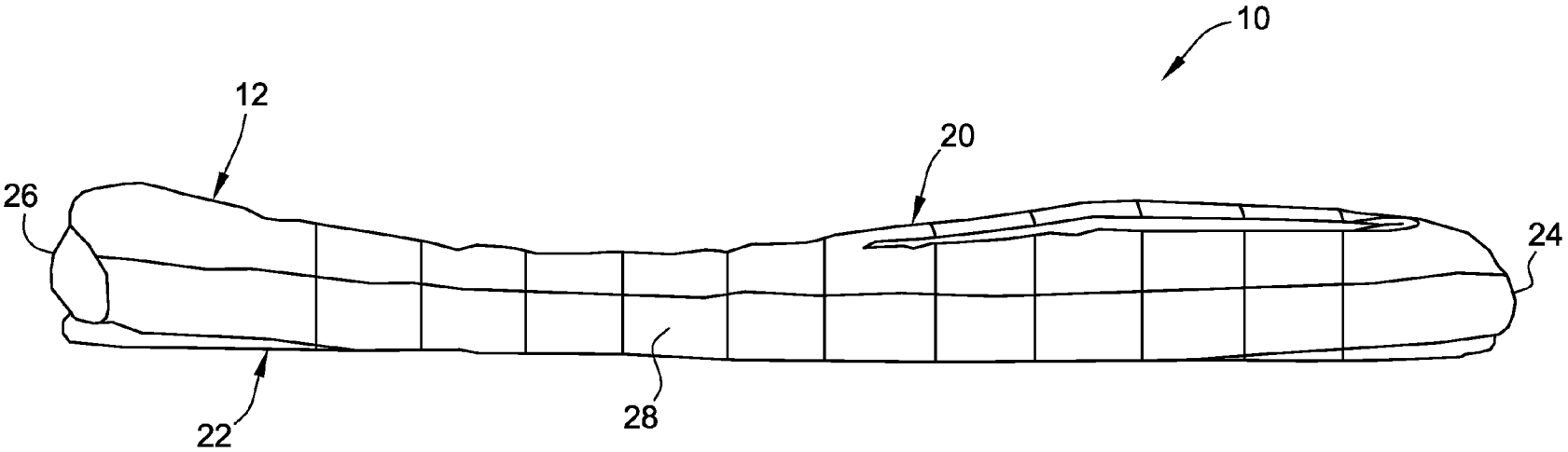
FIG. 6 is a right side elevation of the sleeping bag of FIG. 1.

Referring now to the drawings and in particular to FIGS. 1-6, one suitable embodiment of a sleeping bag is designated in its entirety by the reference number 10. The sleeping bag 10 comprises an elongate shell 12 that defines an inner volume that is sized and shaped to receive a user therein. The shell 12 has a head portion 14, a foot portion 18, and a middle portion 16 that extends longitudinally between the head portion 14 and foot portion 18. In addition, the shell 12 has an overlying portion 20 that is configured to overlie the user and an underlying portion 22 that is configured to underlie the user during use of the sleeping bag 10. In the illustrated embodiment, the sleeping bag 10 is a "zipperless" sleeping bag, i.e., is free from any zippers. In other suitable embodiments, the sleeping bag 10 may have a zipper configured to selectively attach and detach at least a portion of the overlying portion 20 to at least a portion of the underlying portion 22 of the sleeping bag 10. In the illustrated embodiment, the sleeping bag 10 is a "regular" size sleeping bag configured to fit users up to about 6 feet tall. It is understood, however, that the sleeping bag 10 may have any suitable size (e.g., shorter, longer, wider, narrower) and may be configured specifically for men, women, or youths. It is also contemplated that the sleeping bag 10 can be sized and shaped to receive more than one individual (e.g., two individuals).

In the illustrated embodiment, the shell 12 comprises a head end panel 24 located in the head portion 14, a foot end panel 26 located in the foot portion 18, and a pair of spaced side panels 28 located in the middle portion 16. The side panels 28 extend longitudinally between the head end panel 24 and the foot end panel 26 and are symmetrical about a longitudinal centerline CL of the sleeping bag 10. The head end panel 24, the foot end panel 26, and the side panels 28 are stitched into the shell 12 between the overlying portion 20 and underlying portion 22. As a result, the panels 24, 26, 28 collectively provide vertical expansion of the shell 12, thus adding inner volume to the sleeping bag 10. It is contemplated that in some embodiments, the panels 24, 26, 28 can be omitted.

In the illustrated embodiment, the shell 12 is tapered toward the foot portion 18 to generally conform to the contours of the user, being broadest in the head portion 14 corresponding to the shoulders of the user and narrowest in the foot portion 18 corresponding to the feet of the user. The tapered shell 12 thus provides the user a generally snug fit. By generally conforming to the contours of the user and substantially receiving the user therein, air movement within the sleeping bag 10 is substantially reduced, thus making the bag thermally efficient. The illustrated sleeping bag 10 can be generally categorized as a semi-rectangular bag or a tapered bag. It is understood, however, that in other embodiments the sleeping bag 10 could have less taper (e.g., a rectangular-type bag) or have greater taper (e.g., a mummy type bag).

The shell 12 comprises an inner layer 30 that defines the inner volume of the shell 12 and an outer layer 32 that defines an exterior of the shell 12. The inner layer 30 is configured to receive the user occupying the inner volume of the sleeping bag 10. The inner and outer layers 30, 32 can be any suitable material (e.g., polyester). In some embodiments, the inner layer 30 can be made from a material different than the outer layer 32. The shell 12 also comprises an insulation material (not shown) that is located between the inner layer 30 and the outer layer 32 to facilitate providing warmth and softness to the sleeping bag 10. The insulation material can be attached to the inner and outer layers 30, 32 of the shell 12 using stitchlines. It is understood that the insulation material can be any suitable material (e.g., goose down, CLOUDLOFT insulation, DRIDOWN insulation) and that the amount of insulation material can be selected to achieve the desired warmth and softness. The inner and outer layers 30, 32 are stitched together along their periphery edges to enclose the insulation material between the layers 30, 32.

In one suitable embodiment, the sleeping bag 10 has a hood 34 located at the head portion 14 of the shell 12. The hood 34 is configured to receive the head of the user. In addition, the shell 12 has a vent 40 for selectively opening and closing the foot portion 18 of the shell 12. The vent 40 is formed in the shell 12 at the foot portion 18 in the underlying portion 22. The vent 40 enables venting of the inner volume at the foot portion 18 of the sleeping bag 10.

Figure 7:
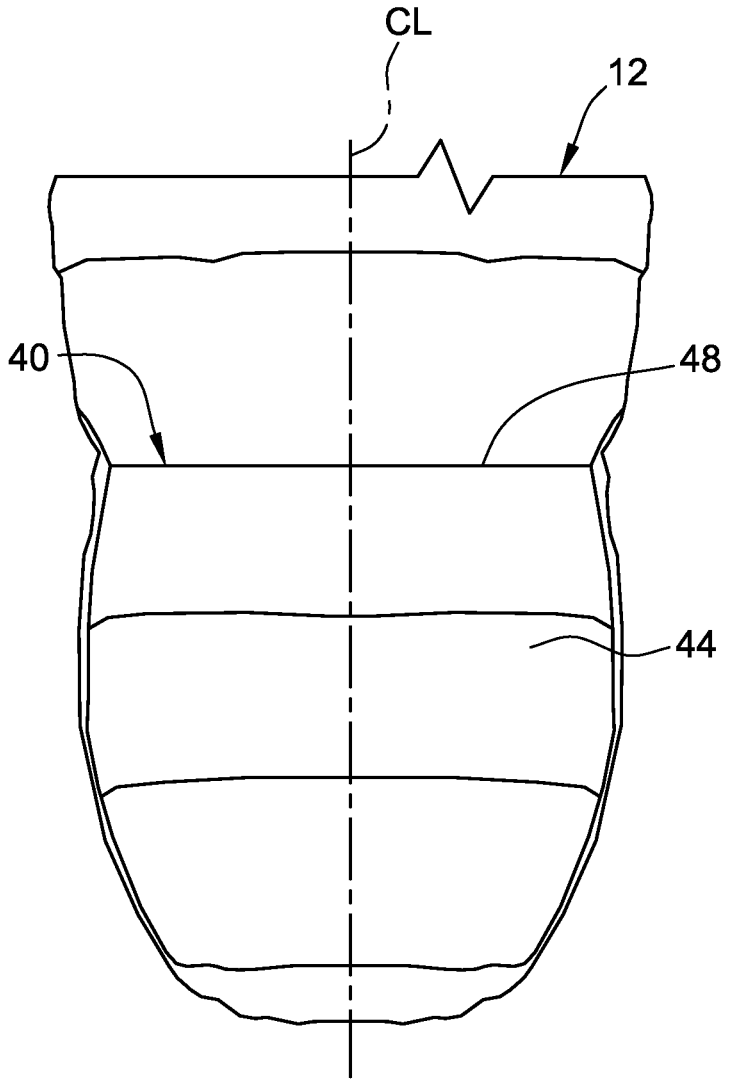
FIG. 7 is an enlarged top plan view of the foot portion of the sleeping bag of FIG. 1 illustrating the interior portion of a ventable foot portion in a closed configuration.
Figure 8:
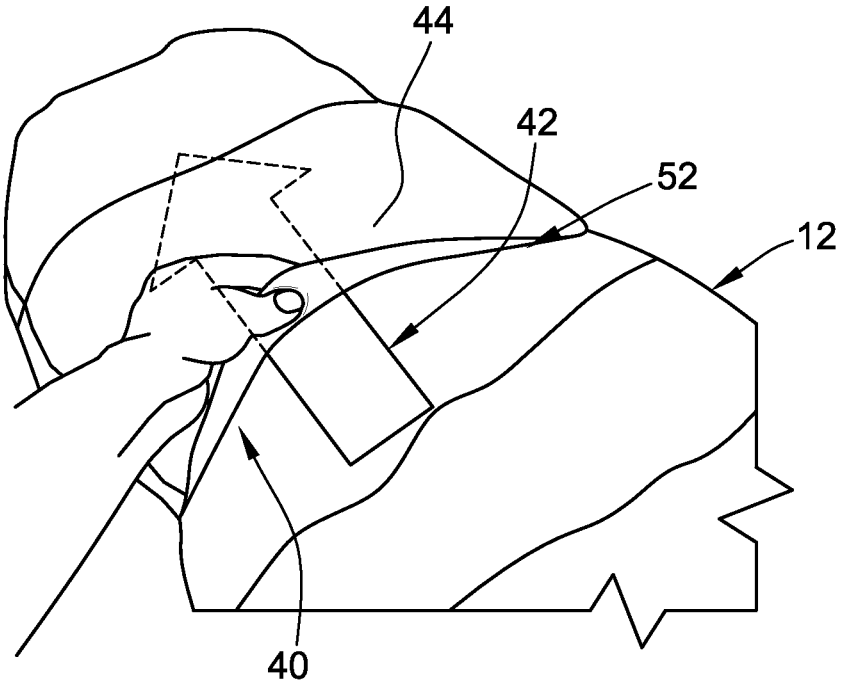
FIG. 8 is an enlarged perspective view of the foot portion of the sleeping bag of FIG. 1 illustrating the interior portion of a ventable foot portion in an opened configuration.
Figure 9:
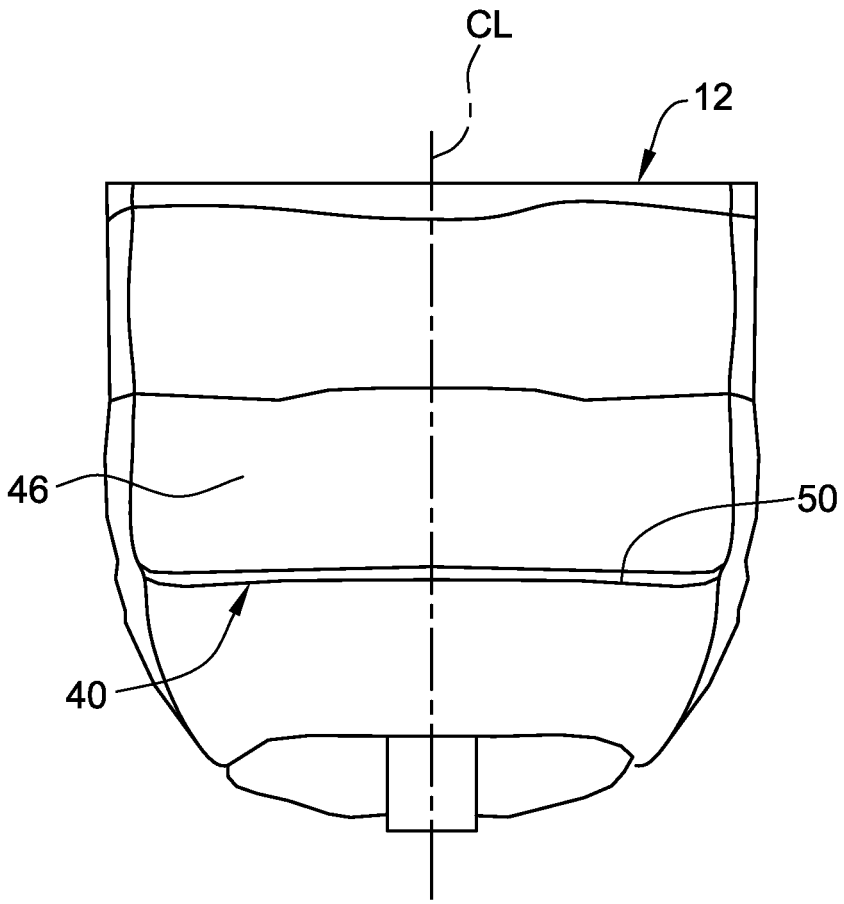
FIG. 9 is an enlarged top plan view of the foot portion of the sleeping bag of FIG. 1 illustrating the exterior portion of a ventable foot portion in a closed configuration.
Figure 10:
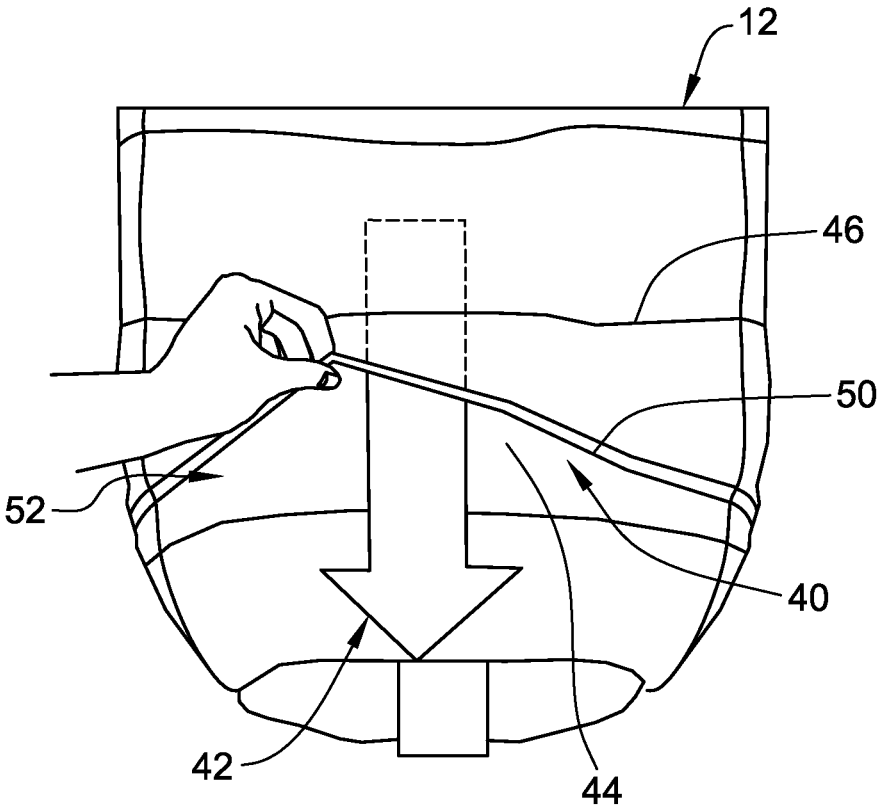
FIG. 10 is an enlarged perspective view of the foot portion of the sleeping bag of FIG. 1 illustrating the exterior portion of a ventable foot portion in an opened configuration.
Figure 11:
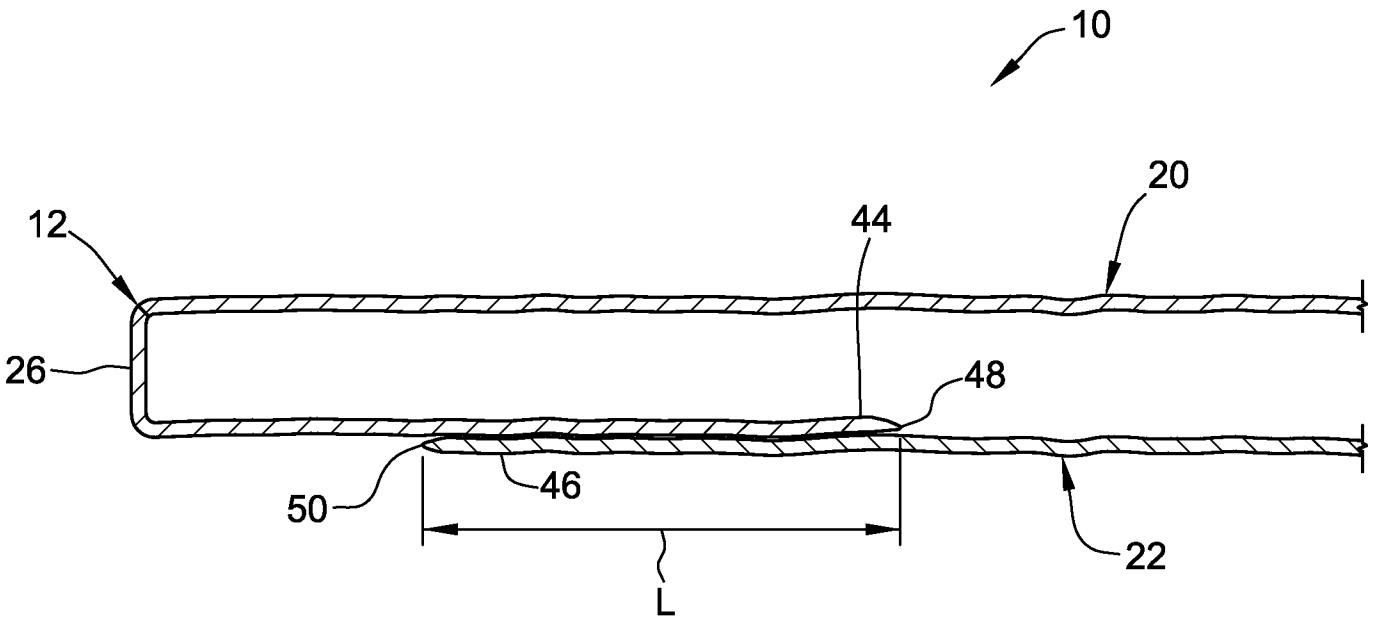
FIG. 11 is an enlarged section view of the foot portion of the sleeping bag of FIG. 1 taken along the longitudinal centerline.
Figure 12:
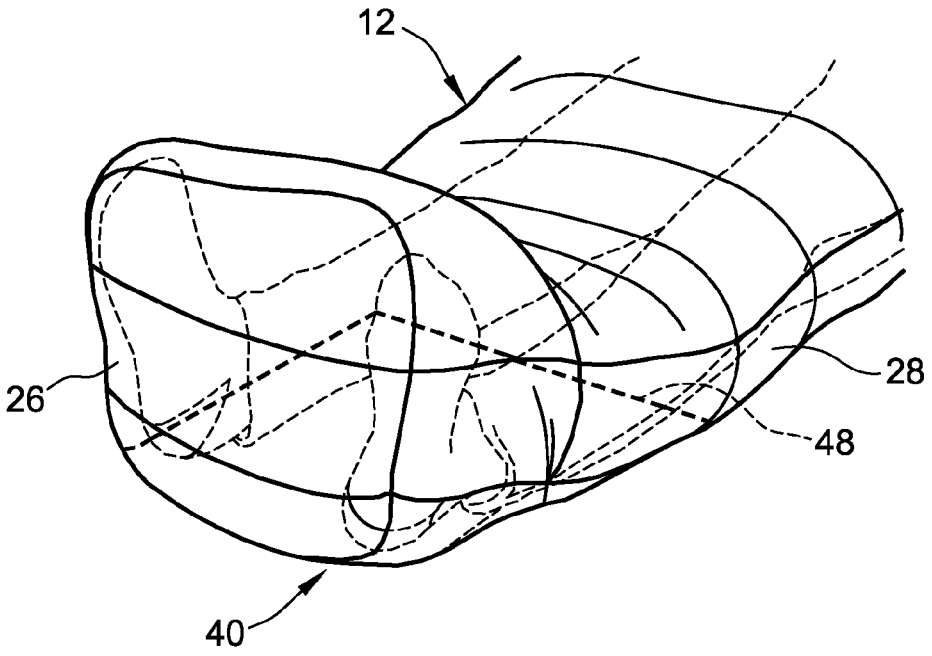
FIG. 12 is an enlarged perspective view of the foot portion of the sleeping bag of FIG. 1 showing a user's feet inside the sleeping bag and the ventable foot portion in a closed configuration.
Figure 13:
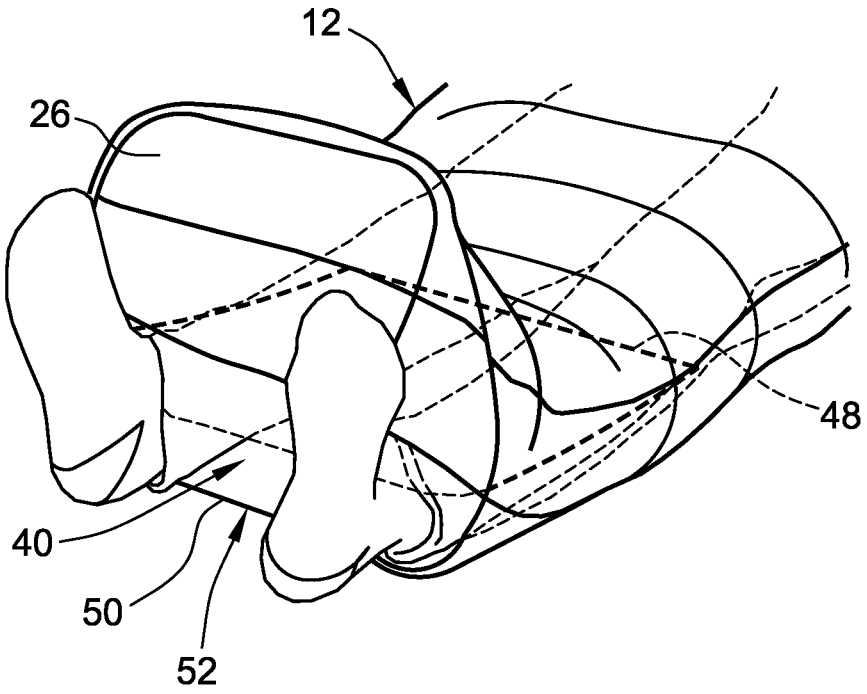
FIG. 13 is an enlarged perspective view of the foot portion of the sleeping bag of FIG. 1 showing a user's feet extending through the ventable foot portion external of the sleeping bag.

With reference to FIGS. 7-13, the illustrated sleeping bag 10, and more specifically, the underlying portion 22 includes the vent 40, which defines a passage 42 through the shell 12 to enable the user to access the exterior of the sleeping bag from within the sleeping bag 10. The vent 40 of the illustrated sleeping bag 10 is located in the underlying portion 22 such that the user can selectively extend his or her feet through the vent 40 (FIG. 13). The vent 40 includes an inner panel 44 and an outer panel 46. A closed configuration, as illustrated for example in FIGS. 7, 9, and 11, is defined by the outer panel 46 overlapping in direct face-to-face relationship the inner panel 44. The overlapping relationship of the outer panel 46 and the inner panel 44 inhibits air from entering the inner volume of the sleeping bag 10 and enables the vent 40 to be self-sealing, i.e., to automatically seal without the use of fasteners. Moreover, the outer panel 46 and inner panel 44 are configured to inhibit the vent 40 from unintentionally opening during use of the sleeping bag 10. In another suitable embodiment, the vent 40 may include a fastener to facilitate maintaining the vent 40 in the closed configuration. For example, without limitation, the vent 40 may include a zipper, snaps, hook and loop fasteners, magnets, or any other suitable fasteners to allow the vent 40 to be held in the closed configuration.

As illustrated for example in FIGS. 8, 10, and 13, an opened configuration is defined by the outer panel 46 being at least in part in spaced relationship to the inner panel 44. In the opened configuration, the user is able to extend his or her foot or feet through the passage 42 of the vent 40 to a location that is external to the inner volume of the sleeping bag 10 (FIG. 13). When the user draws his or her foot or feet back into the sleeping bag 10, the outer panel 46 and inner panel 44 are configured to move back to a face-to-face relationship wherein the vent 40 is moved back to the closed configuration without any additional effort by the user (FIG. 12), i.e., upon the foot or feet being withdrawn from one the vent 40, the outer panel 46 will automatically return to position overlying the inner panel 44.

As illustrated in FIG. 11, in the closed configuration, the outer panel 46 and the inner panel 44 cooperate to define part of the underlying portion 22. The inner panel 44 has an inner free edge 48 and the outer panel 46 has an outer free edge 50. In the illustrated embodiment, the inner panel 44 overlaps the outer panel 46 such that the inner free edge 48 of the inner panel 44 is spaced a predetermined distance L from the outer free edge 50 of the outer panel 46. Distance L is long enough to seal out drafts while still enabling the user to slide his or her foot or feet through the vent 40.

In the illustrated embodiment, the outer panel 46 and the inner panel 44 are made from the same material as the shell 12 (i.e., an inner layer, an outer layer, and an insulation material between the inner and outer layers). It is understood, however, that the outer and inner panels can be made from any suitable material or materials. The illustrated inner and outer panels 44, 46 have a width that is generally the entire width of the underlying portion 22, such that an opening 52 of the vent 40 extends the entire width of the underlying portion 22, substantially perpendicular to the longitudinal centerline CL. It is understood however that the width of the outer panel 46 and the inner panel 44 may be any width that enables the outer and inner panels to function as described herein.

In operation, the vent 40 provides ventilation to the foot portion 18 of the sleeping bag 10 without the need for fasteners (e.g., zippers, snap fasteners, or buttons). It is understood, however, that a fastener may be used to close the vent 40 in other suitable embodiments. The user slides his or her foot or feet under the inner panel 44, passing it through the passage 42 to the exterior of the sleeping bag 10, thereby moving the vent 40 to the opened configuration "hands free," i.e., the user can move the vent 40 to the opened configuration from inside the sleeping bag 10 without the use of his or her hands. In the opened configuration, the user's foot or feet are exterior to the sleeping bag 10 whereby they are exposed to the ambient air, and the passage 42 is at least partially opened enabling ambient air to circulate through the sleeping bag 10 (FIG. 13). To close the vent 40, the user draws his or her foot or feet inside the sleeping bag 10 and places his or her foot or feet on top of the inner panel 44. The inner panel 44 and the outer panel 46 are moved to a face-to-face relationship and the vent 40 is closed to create a seal. In the closed configuration, the user's feet rests on the inner panel 44, wherein the weight of his or her feet facilitates maintaining the vent 40 in the closed configuration (FIG. 12).

Figure 14:
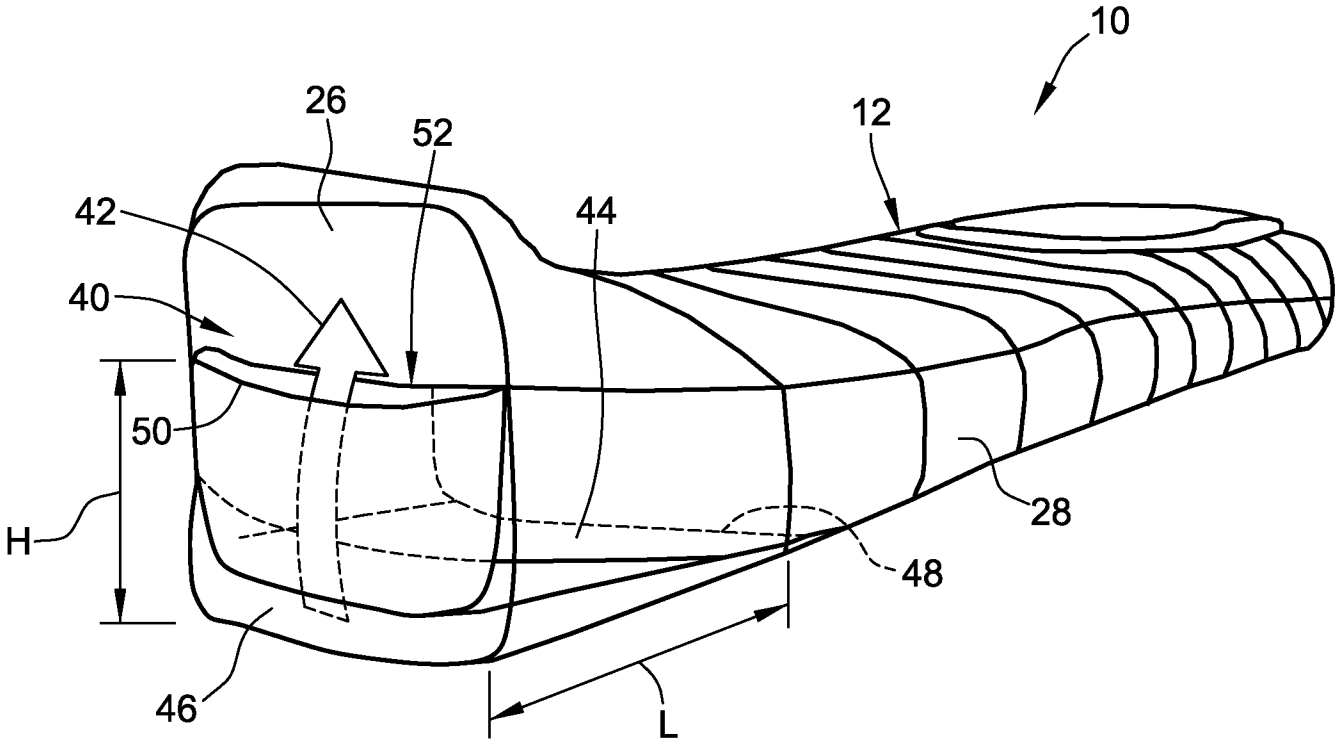
FIG. 14 is a perspective view of another embodiment of a sleeping bag having a vent.

In another suitable embodiment illustrated in FIG. 14, the inner panel 44 and the outer panel 46 extend to the foot end panel 26. That is, the underlying portion 22 is continuous and extends longitudinally between the head end panel 24 and the foot end panel 26, and the vent 40 is located in the foot end panel. The passage 42 extends through the shell 12 to enable the user to access the exterior of the sleeping bag from within the sleeping bag 10. As described above, the closed configuration of the vent 40 is defined by the outer panel 46 overlapping in direct face-to-face relationship with the inner panel 44. The opened configuration is defined by the outer panel 46 being at least in part in spaced relationship to the inner panel 44. As illustrated in FIG. 14, in the closed configuration, the outer panel 46 and the inner panel 44 cooperate to define part of the foot end panel 26 and the underlying portion 22. The inner panel 44 has an inner free edge 48 and the outer panel 46 has an outer free edge 50. The inner panel 44 overlaps the outer panel 46 forming an L-shaped passage 42 such that the inner free edge 48 of the inner panel 44 is spaced a predetermined distance L from the foot end panel 26, and the outer free edge 50 is spaced a predetermined distance H from the underlying portion 22. The combined distance of L and H is long enough to seal out drafts while still enabling the user to slide his or her foot or feet through vent 40.

As previously described, the outer panel 46 and the inner panel 44 are made from the same material as the shell 12 (i.e., an inner layer, an outer layer, and an insulation material between the inner and outer layers). It is understood, however, that the outer and inner panels can be made from any suitable material or materials. The illustrated inner and outer panels 44, 46 have a width that is generally the entire width of the underlying portion 22 and the foot end panel 26, such that an opening 52 of the vent 40 extends the entire width of the underlying portion 22 and the foot end panel 26, substantially perpendicular to the longitudinal centerline CL. It is understood however that the width of the outer panel 46 and the inner panel 44 may be any width that enables the outer and inner panels to function as described herein.

Figure 15:
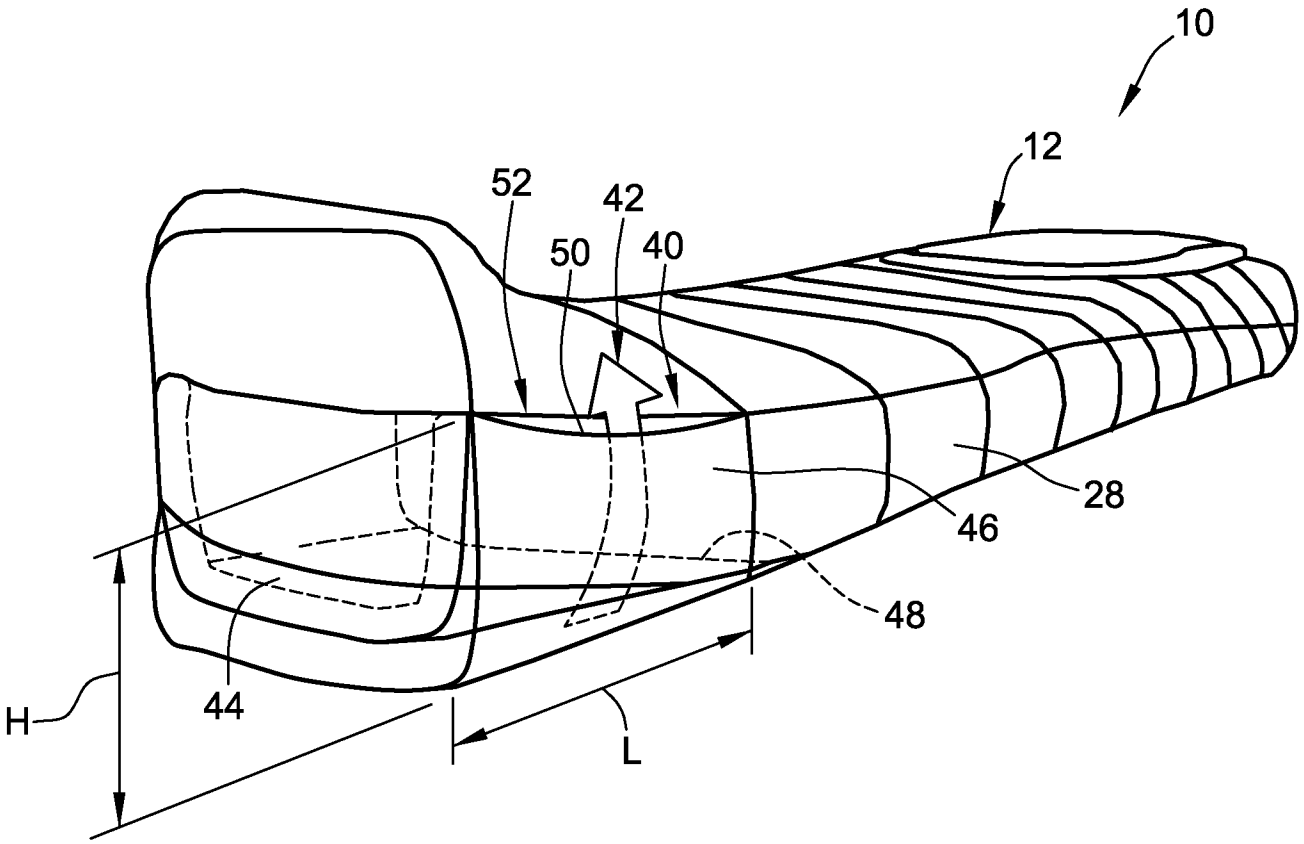
FIG. 15 is a perspective view of yet another embodiment of a sleeping bag having a pair of vents.

In another suitable embodiment illustrated in FIG. 15, a pair of outer panels 46 is positioned in the foot portion 18 of the side panels 28 along with the inner panel 44. In this embodiment, the underlying portion 22 is continuous and extends longitudinally between the head end panel 24 and the foot end panel 26, and the sleeping bag comprises a pair of vents 40, one located in each side panel 28, generally perpendicular to the underlying portion 22 in the closed configuration. The vents 40 are symmetrical about the longitudinal centerline CL of the sleeping bag 10. In the illustrated embodiment, the passage 42 extends through the shell 12 to enable the user to access the exterior of the sleeping bag from within the sleeping bag 10. As described above, the closed configuration of the vent 40 is defined by the outer panel 46 overlapping in direct face-to-face relationship the inner panel 44. The opened configuration is defined by the outer panel 46 being at least in part in spaced relationship to the inner part 44.

As illustrated in FIG. 15, in the closed configuration, one of the outer panels 46 and the inner panel 44 cooperate to define part of one side panel 28 and the underlying portion 22. The other outer panel 46 cooperates with the inner panel 44 to define part of the opposite side panel 28 and the underlying portion 22. The inner panel 44 has an inner free edge 48 and each of the outer panels 46 has an outer free edge 50. The inner panel 44 overlaps the outer panels 46 forming a U-shaped passage 42 such that the inner free edge 48 of the inner panel 44 is spaced a predetermined distance L from the foot end panel 26, and the free edges 50 are spaced a predetermined distance H from the underlying portion 22. The overlap distance of L and H is long enough to seal out drafts while still enabling the user to slide his or her foot or feet through the opening 52 of the vent 40. The openings 52 of the vents 40 are substantially parallel to the longitudinal centerline CL of the shell 12. As previously described, the outer panels 46 and the inner panel 44 are made from the same material as the shell 12 (i.e., an inner layer, an outer layer, and an insulation material between the inner and outer layers). It is understood, however, that the outer and inner panels can be made from any suitable material or materials.

An advantage of the above embodiments is that the vents are lightweight because they do not require any fasteners for closure. Furthermore, the vents are self-sealing vents and enable the user to operate the vents from the inside of the sleeping bag using only his or her feet. In addition, the above disclosed vents provide a tortuous path to inhibit the introduction of air into the interior of the sleeping bag causing loss of heat.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description and shown in the accompanying drawings shall be interpreted as illustrative and not in a limiting sense.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A sleeping bag comprising an elongate shell defining an inner volume sized and shaped to receive a user therein, the shell having a head portion, a foot portion, a middle portion extending longitudinally between the head and foot portions, an overlying portion adapted to overlie the user during use, an underlying portion adapted to underlie the user during use, and a vent, the vent being selectively moveable between a closed configuration and an opened configuration to enable the user to access the exterior of the sleeping bag from within the sleeping bag, the vent comprising an inner panel and an outer panel which cooperate to define at least a portion of the underlying portion of the shell, the inner panel being positioned in overlapping face-to-face engagement with the outer panel in the closed configuration, the outer panel being spaced from the inner panel in the opened configuration to define a passage to enable the user to extend his or her feet through the vent, wherein upon withdrawing the feet from the vent, the outer panel is configured to automatically return to the overlapping face-to-face engagement with the inner panel to self-seal the vent in the closed configuration.

2. The sleeping bag as set forth in claim 1 wherein the inner panel has an inner free edge and the outer panel has an outer free edge, the inner free edge being spaced a predetermined distance from the outer free edge.

3. The sleeping bag as set forth in claim 2 wherein the predetermined distance is adapted to enable sealing the vent and to enable the user to extend his or her feet through the vent.

4. The sleeping bag as set forth in claim 1 wherein the shell has a longitudinal centerline and the vent has an opening, the opening of the vent being located in the underlying portion of the shell, the opening extending across a portion of the underlying portion of the shell substantially perpendicular to the longitudinal centerline.

5. The sleeping bag as set forth in claim 4 wherein the opening of the vent extends the entire width of the underlying portion of the shell.

6. The sleeping bag as set forth in claim 1 wherein the shell further comprises a head end panel, a foot end panel, and a pair of spaced side panels extending longitudinally between the head end panel and the foot end panel.

7. The sleeping bag as set forth in claim 6 wherein the vent has an opening, the opening of the vent being located in the foot end panel.

8. The sleeping bag as set forth in claim 6 wherein the vent has an opening, the opening of the vent being located in at least one of the pair of spaced side panels.

9. A sleeping bag comprising an elongate shell defining a head end panel, and foot end panel, a longitudinal centerline extending longitudinally between the head end panel and the foot end panel, and an inner volume sized and shaped to receive a user therein, the shell having an overlying portion adapted to overlie the user during use, an underlying portion adapted to underlie the user during use, and a vent, the vent having an opening located in the underlying portion and selectively rotatably moveable between a closed configuration and an opened configuration to enable the user to access the exterior of the sleeping bag from within the sleeping bag, the foot end panel is substantially perpendicular to the longitudinal centerline and configured to rotate relative to the longitudinal centerline to selectively move the vent, the opening extending substantially perpendicular to the longitudinal centerline in the opened configuration, the vent being fastener free.

10. The sleeping bag as set forth in claim 9 wherein the vent comprises an inner panel and an outer panel, the inner panel being positioned in overlapping face-to-face engagement with the outer panel in the closed configuration, the outer panel being spaced from the inner panel in the opened configuration to define a passage to enable the user to extend his or her feet through the vent.

11. The sleeping bag as set forth in claim 10 wherein the inner panel has width that is substantially equal to the width of the outer panel.

12. The sleeping bag as set forth in claim 10 wherein the opening extends across at least a portion of the underlying portion of the shell.

13. The sleeping bag as set forth in claim 12 wherein the opening of the vent extends the entire width of the underlying portion of the shell.

14. The sleeping bag as set forth in claim 10 wherein the shell further comprises a head end panel, a foot end panel, and a pair of spaced side panels extending longitudinally between the head end panel and the foot end panel.

15. The sleeping bag as set forth in claim 14 wherein the opening of the vent is located in the foot end panel.

16. A sleeping bag comprising an elongate shell defining a longitudinal centerline and an inner volume sized and shaped to receive a user therein, the shell having a head end panel, a foot end panel, and a pair of spaced side panels extending longitudinally between the head end panel and the foot end panel, an overlying portion adapted to overlie the user during use, an underlying portion adapted to underlie the user during use, and a pair of vents selectively moveable between a closed configuration and an opened configuration to enable the user's feet to access the exterior of the sleeping bag from within the sleeping bag, each of the vents comprising an inner panel and an outer panel, the inner panel being positioned in overlapping face-to-face engagement with the outer panel in the closed configuration, the inner panel and the outer panel being generally perpendicular to the underlying portion in the closed configuration, wherein upon withdrawing the user's feet from the vent, each outer panel is configured to automatically return to the overlapping face-to-face engagement with the respective inner panel to self-seal each vent in the closed configuration.

17. The sleeping bag as set forth in claim 16 wherein each of the vents has an opening that extends substantially parallel to the longitudinal centerline of the shell, in the open configuration of each of the vents, the outer panel is spaced from the inner panel to define a U-shaped passage to enable the user to extend his or her feet through the opening.

18. The sleeping bag as set forth in claim 17 wherein each opening is located in a respective one of the pair of spaced side panels.

19. The sleeping bag as set forth in claim 18 wherein the inner panel defines at least a portion of the pair of spaced side panels and overlies at least a portion of the underlying portion of the shell to facilitate providing a tortuous path to inhibit air entering into the interior of the sleeping bag.

20. The sleeping bag as set forth in claim 10 wherein the passage is L-shaped.

21. The sleeping bag as set forth in claim 17 wherein the passage is U-shaped.

* * * * *